US007819113B2

(12) United States Patent
Chin

(10) Patent No.: US 7,819,113 B2
(45) Date of Patent: Oct. 26, 2010

(54) DOOR ASSEMBLY FOR A COOKING APPARATUS

(75) Inventor: Jae Myeung Chin, Gimhae (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/802,861

(22) Filed: May 25, 2007

(65) Prior Publication Data

US 2007/0271847 A1 Nov. 29, 2007

(30) Foreign Application Priority Data

May 29, 2006 (KR) ..... 10-2006-0048267

(51) Int. Cl.
*F24C 15/04* (2006.01)

(52) U.S. Cl. ..... 126/200; 126/190; 126/192; 126/193; 126/198; 126/273 R; 49/381; 49/400; 49/401; 99/348; 110/112; 110/116

(58) Field of Classification Search ..... 126/200, 126/190, 191, 192, 193, 194, 197, 198, 21 A, 126/519, 500, 546, 547, 273 R; 49/70, 400, 49/381, 401; 110/173, 112, 116, 172; 219/391, 219/739, 757, 682, 679; 99/348, 341; 52/784.1, 52/455, 171.1

See application file for complete search history.

(56) References Cited

U.S. PATENT DOCUMENTS 3,996,710 A * 12/1976 Nuss ..... 52/202
4,084,572 A * 4/1978 Schettl et al. ..... 126/200
5,441,036 A * 8/1995 Mikalauskas et al. ..... 126/198
5,789,724 A * 8/1998 Lerssen et al. ..... 219/741
5,881,710 A * 3/1999 Davis et al. ..... 126/194
6,024,084 A * 2/2000 Gerhardinger ..... 126/200
2006/0027230 A1 * 2/2006 Jung ..... 126/200

FOREIGN PATENT DOCUMENTS

KR 1998-014810 6/1998
KR 10-2006-0039541 5/2006

OTHER PUBLICATIONS

Korean Office Action dated Mar. 29, 2007.

* cited by examiner

*Primary Examiner*—Steven B McAllister
*Assistant Examiner*—Avinash Savani
(74) *Attorney, Agent, or Firm*—KED & Associates, LLP

(57) ABSTRACT

A door assembly for a cooking apparatus is provided that prevents heat generated in a cooking chamber from being released to the outside while also being as thin as possible. The door assembly may include a glass support that supports a first glass panel on a front side, and a second glass panel on a rear side. The second glass panel may be supported by a seating protrusion and catching protrusions formed on the rear side of the glass support. A door frame may be coupled to the rear side of the glass support, with a third glass panel coupled to either a front or rear side thereof. A cover frame may be coupled to the rear side of the glass support to enclose the first, second and third glass panels and the door frame.

13 Claims, 4 Drawing Sheets

DOOR ASSEMBLY FOR A COOKING APPARATUS

This claims the benefit of Korean Patent Application No. 2006-0048267 filed in Korea on May 29, 2006, the entirety of which is incorporated herein by reference.

BACKGROUND

1. Field

This relates to a cooking apparatus, and more particularly, to a door assembly for a cooking apparatus.

2. Background

In general, a cooking apparatus is a device for heating food, and may include, for example, a conventional oven, a convection oven, a microwave oven, a combination microwave/convection oven and the like.

A microwave oven cooks food using microwaves, and a convection oven cooks food using a heat source such as, for example, a gas burner, an electric heater, or other such heat source. A microwave oven typically cooks an inner portion of food first, while a convection oven typically cooks an outer portion of food first. A combination microwave and convection oven is capable of cooking food using microwaves and/or a heater simultaneously or selectively. A combination microwave and convection oven uniformly heats the inner portion of food using microwaves, and also uniformly heats the outer portion of food using the heater. By combining a variety of heat sources, a temperature in the cooking chamber of a combination microwave and convection oven may be raised to a much higher temperature within a short time, and the food can be cooked quickly and thoroughly.

However, due to this the high-temperature environment, a combination microwave and convection oven requires a door assembly capable of preventing heat from being released and microwaves from leaking out while also minimizing a thickness of the door assembly.

BRIEF DESCRIPTION OF THE DRAWINGS

The embodiments will be described in detail with reference to the following drawings in which like reference numerals refer to like elements wherein.

DETAILED DESCRIPTION

Figure 1:
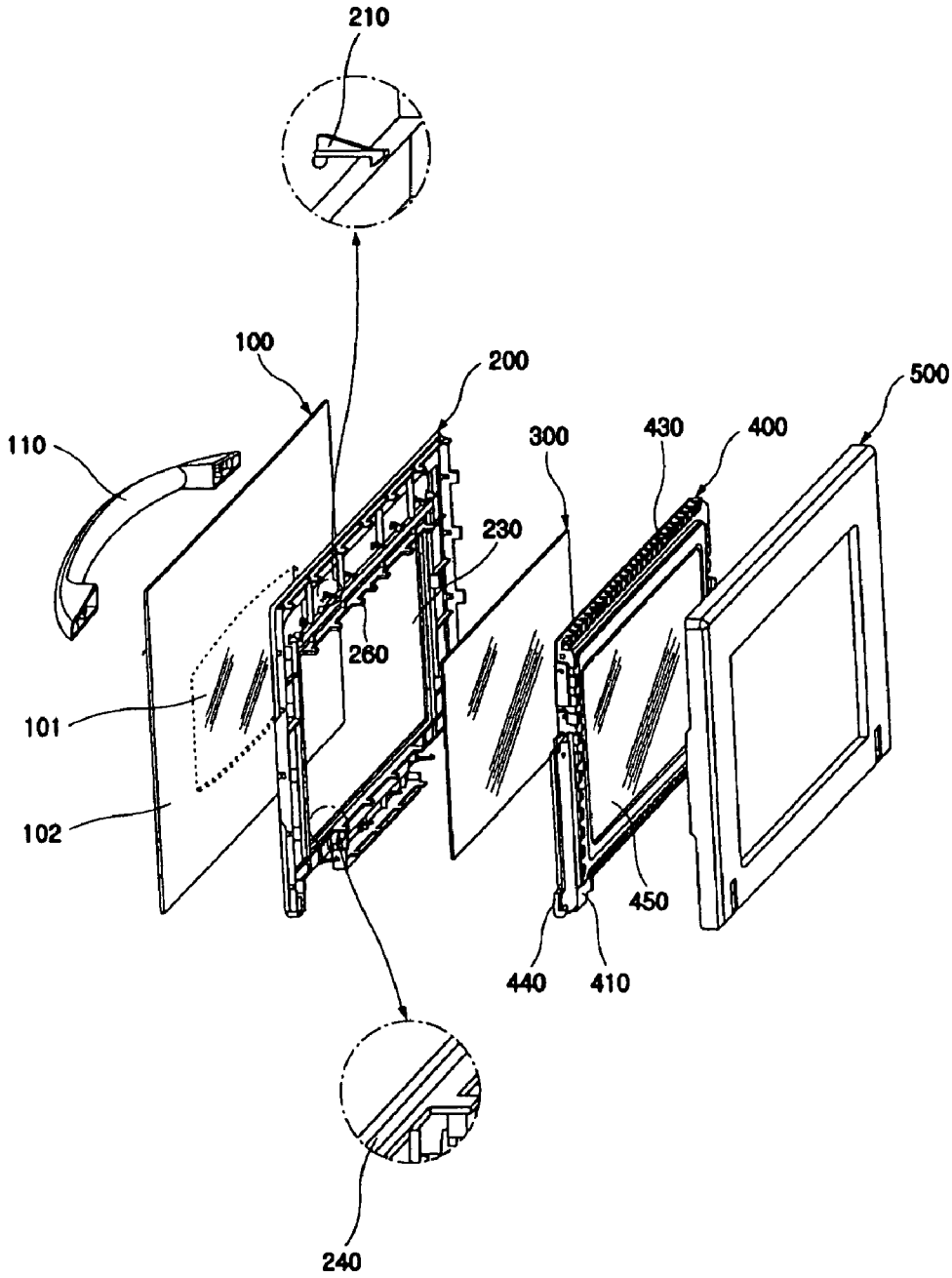
FIG. 1 is an exploded perspective view of a door assembly for an exemplary cooking apparatus in accordance with embodiments as broadly described herein.
Figure 2:
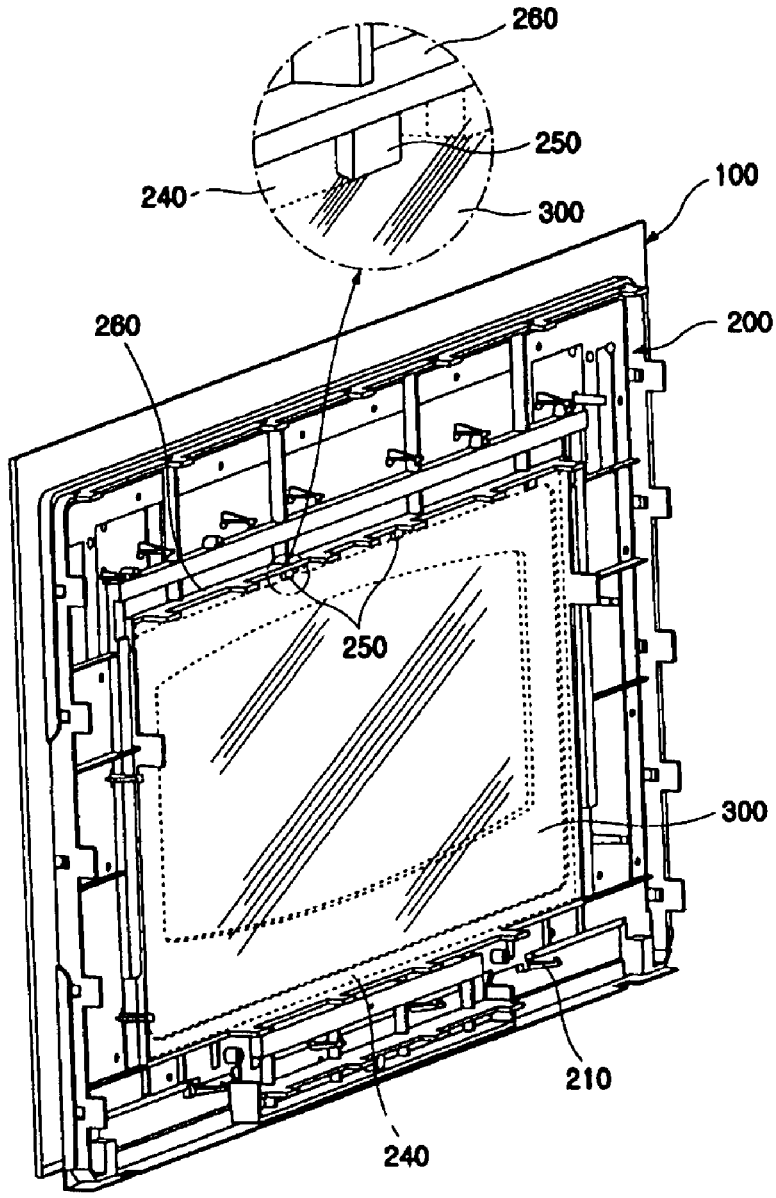
FIG. 2 is a partially assembled perspective view of the door assembly shown in FIG. 1, with a reflective glass mounted on a glass support, in accordance with embodiments as broadly described herein.

As shown FIG. 1, a door assembly for a cooking apparatus, such as, for example, a combination microwave and convection oven, may include a door glass 100, a glass support 200, a reflective glass 300, a door frame 400 and a cover frame 500. For ease of discussion, the door assembly as embodied and broadly described herein will be described with respect to a combination microwave and convection oven. However, embodiments of the door assembly may also be adapted for use on other types of cooking devices as appropriate. A more detailed discussion of the components and operation of a microwave oven and/or a combination microwave can be found in Korean Patent Application Nos. 10-2006-0084335, 10-2006-0088289, 10-2006-0088293, 10-2006-0088288, 10-2006-0088294, 10-2006-0088295, 10-2006-0088296, and 2006-0048268, the entirety of which is incorporated herein by reference.

The door glass 100 may form a front side of the door assembly and may be made of a glass material. An inner portion 101 of the door glass 100 may be transparent such that an interior of a cooking chamber may be viewed from the outside, while an outer portion 102 may be opaque. Other components of the door assembly may be coupled to the opaque outer portion 102 of the door glass 100 so that the other components cannot be seen from the outside. A handle 110 may be coupled to a front surface of the door glass 100 to facilitate opening and closing the door assembly.

The glass support 200 may be formed as a rectangular frame with an open inner portion 230, and the door glass 100 may be coupled to a front surface of the glass support 200. The door glass 100 may be attached to the glass support 200 using an adhesive (not shown), or other suitable attachment means. In certain embodiments, use of an adhesive may avoid an increase in overall thickness of the door assembly that may occur when compared to other structure which may be employed to couple the door glass 100 to the glass support 200. In certain embodiments, such an adhesive may be made of a material, such as, for example, a sealant, that is also capable of preventing water or heat from being released.

A plurality of coupling hooks 210 or ribs 220 may be provided on a rear surface of the glass support 200 for coupling the glass support 200 to the door frame 400 and/or the cover frame 500. In particular, a seating protrusion 240 may be stepwise formed on a rear surface of the glass support 200 along a periphery of the opened portion 230 (hereinafter, referred to as an "opening"). The seating protrusion 240 may form a stepped portion for supporting an edge of the reflective glass 300.

One or more catching protrusions 250 may be formed along the periphery of the opening 230 extending toward a central portion of the opening 230. The catching protrusions 250 may support a rear surface of the reflective glass 300 to prevent the reflective glass from being separated (in a rearward direction) from the seating protrusion 240 of the glass support 200. A step depth of the seating protrusion 240 may be substantially the same as a thickness of the reflective glass 300, and the catching protrusion 250 may be spaced apart from the seating protrusion 240 by the same distance as the thickness of the reflective glass 300. This structure may prevent the reflective glass 300 mounted in the seating protrusion 240 from being moved between the seating protrusion 240 and catching protrusions 250.

An upper supporting portion 260 for supporting an upper end of the reflective glass 300 may also be formed along an upper periphery of the opening 230, with the catching protrusion 250 protruding downward from the upper supporting portion 260 to support an upper rear portion of the reflective glass 300. The upper supporting portion 260 may also maintain a coupling distance between the glass support 200 and the cover frame 500 while supporting the upper end of the reflective glass 300 as described above.

The reflective glass 300 may be selected so as to prevent heat and/or ultraviolet rays generated in the cooking chamber from being released and/or exposed to the outside. In certain embodiments, the reflective glass 300 may be glass with a coating layer made of at least one of aluminum (Al), chrome (Cr), nickel (Ni) and titanium (Ti) applied on a surface thereof. The reflective glass 300 may be secured on the seating protrusion 240 on the rear surface of the glass support 200 so as to cover the opening 230 in the glass support 200.

Figure 3:
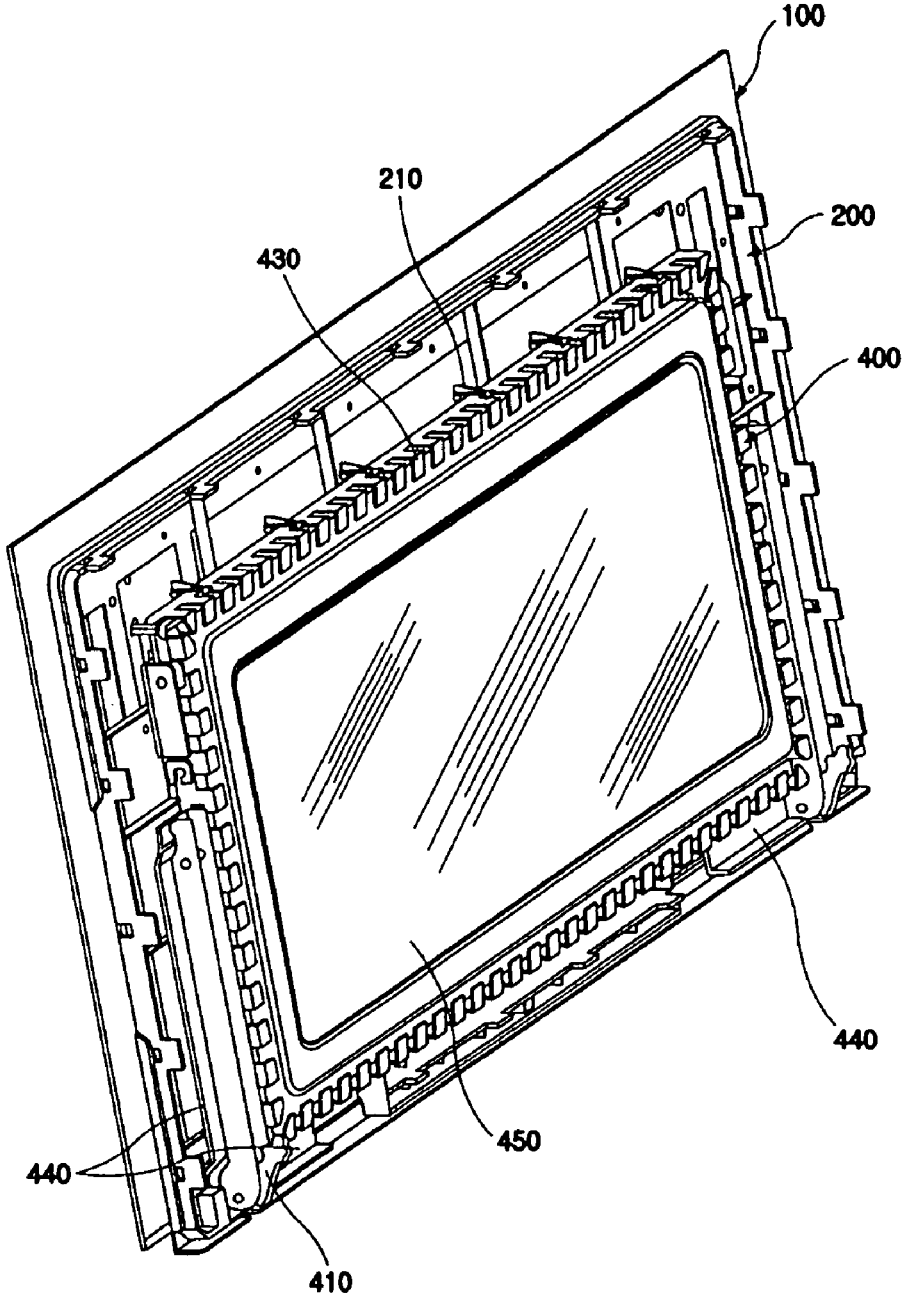
FIG. 3 is a perspective view of the door assembly shown in FIGS. 1-2, with a door frame coupled to the glass support, in accordance with embodiments as broadly described herein.

The door frame 400 may provide a body structure for the door assembly. The door frame 400 may include a hinge assembly 410 which is pivotally coupled to the combination microwave and convection oven. As shown in FIG. 3, the door frame 400 may be coupled to the rear surface of the glass support 200 such that the reflective glass 300 is interposed between the door frame 400 and the glass support 200.

An inner portion of the door frame 400 may include a porous plate 420, and an outer portion of the door frame 400 may include a choke portion 430. The porous plate 420 may prevent microwaves in the cooking chamber from leaking out while still allowing the cooking chamber to be viewed from the outside. The choke portion 430 may prevent the microwaves from leaking out.

In the embodiment of the door assembly shown in FIGS. 1-4, lower corner portions of a front surface of the door frame 400 may support a lower rear end of the reflective glass 300 which is securely placed on the seating protrusion 240 of the glass support 200. Accordingly, since an additional structure for supporting the lower end of the reflective glass 300 is not required, it is possible to prevent the overall thickness of the door assembly from being increased due to unnecessary supporting structure. Instead, in alternative embodiments, supporting portions 440 may be provided at the two lower corner portions of the front surface of the door frame 400. Each of the supporting portions 440 may surround the two lower corner portions of the front surface of the door frame 400 to simultaneously support the lower rear end of the reflective glass 300. The hinge assembly 410 may be coupled to a rear surface of each of the supporting portions 440. Thus, the supporting portion 440 may support the reflective glass 300 and also function as a bracket for the hinge assembly 410, whereby an increase in the overall thickness of the door assembly can be minimized.

Heat resistant glass 450 for preventing heat in the cooking chamber from being released to the outside may be provided on at least one of front and rear surfaces of the door frame 400. The heat resistant glass 450 may be transparent and may enclose the open inner portion of the door frame 400.

The cover frame 500 may be coupled to the rear surface of the glass support 200 such that the reflective glass 300 and the door frame 400 are interposed between the cover frame 500 and the glass support 200 and the cover frame 500 defines a rear surface of the door assembly. The cover frame 500 may be formed as a rectangular frame with an open inner portion to surround the reflective glass 300 and the door frame 400. The cover frame 500 and the glass support 200 may be coupled to each other by a plurality of hooks 210 and ribs 220 formed on the rear surface of the glass support 200 and/or screws or other suitable fastener (not shown).

A process for assembling a door assembly for a cooking apparatus, such as, for example, a combination microwave and convection oven, as embodied and broadly described herein will now be described.

First, the door glass 100 may be coupled to the front surface of the glass support 200 using an adhesive, such as, for example, a sealant such that heat cannot be released and a stable coupling state can also be maintained. Other attachment means may also be appropriate. After the glass support 200 has been coupled to the door glass 100, the reflective glass 300 may be securely placed on the seating protrusion 240 formed on the rear surface of the glass support 200. To this end, the upper end of the reflective glass 300 may first be inserted between the catching protrusions 250 and seating protrusion 240 formed along the upper periphery of the opening 230, and the lower end of the reflective glass 300 may then be securely placed on the seating protrusion 240 formed along the lower periphery of the opening 230. Thus, the reflective glass 300 may be stably seated on the seating protrusion 240.

Figure 4:
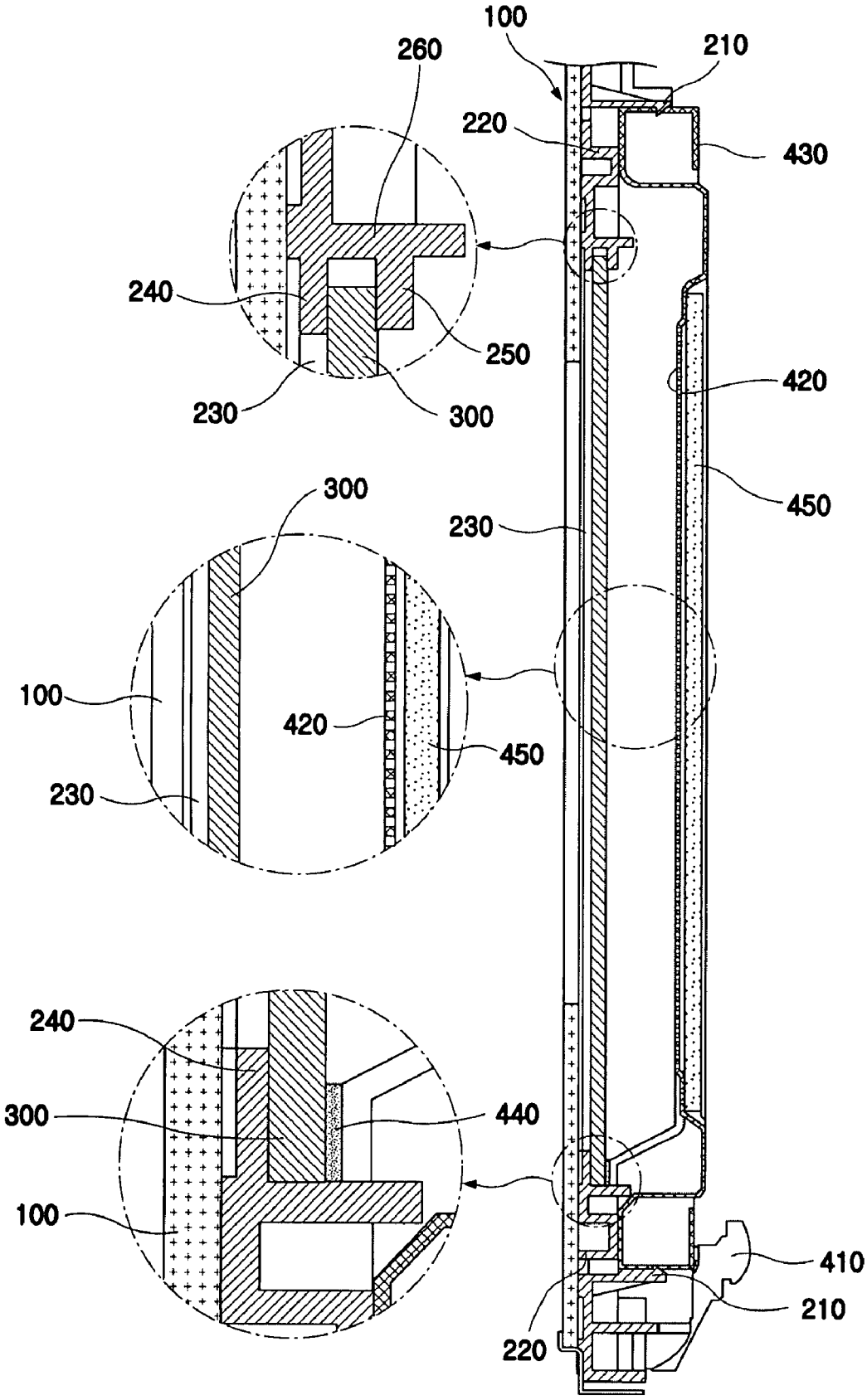
FIG. 4 is a side sectional view of the door assembly shown in FIGS. 1-3, in accordance with embodiments as broadly described herein.

The door frame 400 may be coupled to the rear surface of the glass support 200. To this end, the lower rear end of the reflective glass 300 may be supported by the supporting portions 440 provided at opposite lower corners on the front surface of the door frame 400. Detachment of the lower end of the reflective glass 300 from the seating protrusion 240 may be prevented due to pressure applied to the reflective glass 300 by the supporting portions 400. Accordingly, this stable coupling of the door frame 400 to the glass support 200 maintains a stable position of the reflective glass 300 on the seating protrusion 240, as shown in FIG. 4.

The cover frame 500 may then be coupled to the glass support 200 so that the reflective glass 300 and the door frame 400 are placed between the cover frame 500 and the glass support 200. The cover frame 500 may surround the reflective glass 300 and the door frame 400, and may be coupled to the cover frame 500 by the hook 210, screws (not shown), or other suitable fasteners. Therefore, the reflective glass 300 and the door frame 400 so assembled are not exposed to the outside.

The hinge assembly 410 installed at the supporting portion 440 of the door frame 400 may pass through the cover frame 500 and be pivotally coupled to a front surface of the cooking apparatus to complete fabrication of the door assembly.

A door assembly as embodied and broadly described herein can stably prevent microwaves from leaking out and also prevent heat in the cooking chamber from being released to the outside.

Additionally, a door assembly as embodied and broadly described herein is suitable for numerous types of cooking devices, such as, for example, a combination microwave and convection oven, due to its thinner profile, and in particular a combination microwave and convection oven which may be installed in a built-in manner.

Further, a door assembly as embodied and broadly described herein can be simply fabricated since the movement of the reflective glass is prevented by only the engaging protrusion and the door frame and, since an additional structure for coupling the reflective glass to the door frame is not required, a number of parts can be reduced and thus manufacturing costs can be reduced.

In certain embodiments, a door assembly for a combination microwave and convection oven is provided which is as thin as possible and capable of preventing heat in a cooking chamber from releasing to the outside.

In accordance with embodiments as broadly described herein, there is provided a door assembly for a combination microwave and convection oven, including a door glass provided at a front surface of the door assembly, a glass support including an inner portion formed with an opening, a front surface to which the door glass is coupled, and a rear surface on which a seating protrusion is formed along a periphery of the opening; a reflective glass placed on the seating protrusion of the glass support, and at least an engaging protrusion protruding from the periphery of the opening on a rear surface of the glass support toward an inner portion of the opening to support a rear surface of the reflective glass.

The door assembly may also include an upper supporting portion provided on an upper portion of the periphery of the opening of the glass support to support an upper end of the reflective glass.

A stepped depth of the seating protrusion may be almost the same as a thickness of the reflective glass.

The engaging protrusion may be spaced apart from the seating protrusion by the same distance as a thickness of the reflective glass.

The door assembly may also include a door frame coupled to the rear surface of the glass support in a state where the reflective glass is placed between the door frame and the glass support, and the door frame includes an inner portion formed of a porous plate.

Two lower corner portions on a front surface of the door frame may support a lower rear end of the reflective glass, or lower supporting portions for surrounding and supporting a lower rear end of the reflective glass may be provided at two lower corner portions on a front surface of the door frame, respectively.

Each of the lower supporting portions may be coupled with a hinge assembly at a rear surface thereof.

The door assembly may also include heat resistant glass provided on at least one of front and rear surfaces of the door frame to prevent heat in a cooking chamber from being released to the outside.

The door assembly may also include a cover frame coupled to the glass support in a state where the reflective glass and the door frame are interposed between the cover frame and the glass support.

In accordance with another embodiment as broadly described herein, there is provided a door assembly for a combination microwave and convection oven, including a door glass provided at a front surface of the door assembly, a glass support including an inner portion formed with an opening, a front surface to which the door glass is coupled, and a rear surface on which a seating protrusion is formed along a periphery of the opening, a reflective glass placed on the seating protrusion of the glass support, an upper supporting portion formed on an upper portion of the periphery of the opening of the glass support to support an upper end of the reflective glass, and at least an engaging protrusion protruding from the upper supporting portion to support a tear surface of the reflective glass.

A stepped depth of the seating protrusion may be almost the same as a thickness of the reflective glass.

The engaging protrusion may be spaced apart from the seating protrusion by the same distance as a thickness of the reflective glass.

The door assembly may also include a door frame coupled to the rear surface of the glass support in a state where the reflective glass is placed between the door frame and the glass support, the door frame including an inner portion formed of a porous plate.

Two lower corner portions on a front surface of the door frame may support a lower rear end of the reflective glass; or lower supporting portions for surrounding and supporting a lower rear end of the reflective glass may be provided at two lower corner portions on a front surface of the door frame, respectively.

Each of the lower supporting portions is coupled with a hinge assembly at a rear surface thereof.

The door assembly may also include heat resistant glass provided on at least one of front and rear surfaces of the door frame to prevent heat in a cooking chamber from being released to the outside.

The door assembly may also include a cover frame coupled to the glass support in a state where the reflective glass and the door frame are interposed between the cover frame and the glass support.

Any reference in this specification to "one embodiment," "an embodiment," "example embodiment," "certain embodiment," alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A door assembly for a cooking apparatus, comprising:

a first glass panel;

a glass support having an opening formed in a central portion thereof, wherein the first glass panel is coupled to a front surface of the glass support by an adhesive;

a seating protrusion formed on a rear surface of the glass support along only a lower periphery of the opening in the glass support;

an upper supporting portion formed along an upper periphery of the opening in the glass support;

lower supporting portions formed at the lower periphery of the opening in the glass support;

a second glass panel positioned on the seating protrusion of the glass support;

a catching protrusion that extends only from the upper periphery of the opening in the glass support toward a center of the opening, wherein a rear surface of the second glass panel is positioned against the catching protrusion;

a door frame coupled to the rear surface of the glass support such that the second glass panel is positioned between the door frame and the glass support, wherein two lower corner portions are respectively provided at two lower corners of the door frame so as to extend to a corresponding front surface of the door frame, wherein a front surface of the two lower corner portions maintains a lower rear end of the second glass panel against the glass support;

a third glass panel provided on a rear surface of the door frame, wherein the third glass panel inhibits the transfer of heat therethrough;

a hinge assembly coupled to a rear side of each of the two lower corner portions of the door frame; and a cover frame coupled to the glass support such that the second glass panel and the door frame are interposed between the cover frame and the glass support.

2. The door assembly as claimed in claim 1, wherein a corresponding upper edge of the second glass panel is positioned against the upper supporting portion.

3. The door assembly as claimed in claim 1, wherein a stepped depth of the seating protrusion is substantially the same as a thickness of the second glass panel.

4. The door assembly as claimed in claim 1, wherein a distance between the catching protrusion and the seating protrusion is substantially the same as a thickness of the second glass panel.

5. The door assembly as claimed in claim 1, wherein the third glass panel is made of a heat resistant glass material.

6. The door assembly as claimed in claim 1, wherein the door frame includes a porous plate provided on an inner surface thereof.

7. The door assembly as claimed in claim 1, wherein the first glass panel forms a front surface of the door assembly, and wherein the second glass panel is made of a reflective glass material.

8. The door assembly as claimed in claim 1, wherein the cooking apparatus is at least one of a microwave oven, a convection oven, or a combination microwave and convection oven.

9. A door assembly for a cooking apparatus, comprising:

a glass support;

a first glass panel coupled to a front surface of the glass support by an adhesive;

a second glass panel coupled to a rear surface of the glass support;

an upper supporting portion formed on an upper periphery of an opening in the glass support, wherein an upper end of the second glass panel is positioned against the upper supporting portion;

a catching protrusion protruding from the upper supporting portion and extending toward a central portion of the glass support such that a rear surface of the second glass panel is positioned against the catching protrusion;

a seating portion formed on a lower periphery of the opening in the glass support;

a door frame coupled to the rear surface of the glass support such that the second glass panel is placed between the door frame and the glass support, the door frame including an inner portion comprising a porous plate, wherein lower supporting portions are provided at two lower corner portions on a front surface of the door frame corresponding to the lower periphery of the opening in the glass panel, wherein the lower supporting portions surround and maintains a lower rear end of the second glass panel against the glass support;

a third glass panel provided on a rear surface of the door frame, wherein the third glass panel inhibits the transfer of heat therethrough;

a hinge assembly coupled to a rear side of each of the lower supporting portions; and a cover frame coupled to the glass support such that the second glass panel and the door frame are interposed between the cover frame and the glass support.

10. The door assembly of claim 9, wherein the second glass panel is positioned on the seating protrusion of the glass support.

11. The door assembly as claimed in claim 10, wherein a stepped depth of the seating protrusion is substantially the same as a thickness of the second glass panel.

12. The door assembly as claimed in claim 10, wherein a distance between the catching protrusion and the seating protrusion is substantially the same as a thickness of the second glass panel.

13. The door assembly as claimed in claim 9, wherein the cooking apparatus is a microwave oven, a convection oven, or a combination microwave and convention oven.

* * * * *